United States Patent [19]

Yocum

[11] 4,206,832

[45] Jun. 10, 1980

[54] DRONE ACOUSTICAL TRANSDUCER

[76] Inventor: Thomas A. Yocum, Jack Oak Rd., Cassville, Wis. 53806

[21] Appl. No.: 4,148

[22] Filed: Jan. 17, 1979

[51] Int. Cl.[2] ..... G10K 13/00

[52] U.S. Cl. ..... 181/166; 181/172; 181/173

[58] Field of Search ..... 181/171, 172, 173, 156, 181/157, 163, 166

[56] References Cited

U.S. PATENT DOCUMENTS

| | | | |
|---|---|---|---|
| 1,939,922 | 12/1933 | Rockwell | 181/172 |
| 2,534,040 | 12/1950 | Lindley | 181/166 |
| 3,669,215 | 6/1972 | Kikuchi et al. | 181/172 |
| 3,905,448 | 9/1975 | Kawakami et al. | 181/172 |

*Primary Examiner*—L. T. Hix
*Assistant Examiner*—Benjamin R. Fuller
*Attorney, Agent, or Firm*—Darbo & Vandenburgh

[57] ABSTRACT

A drone acoustical transducer for a loudspeaker system has an improved means of interconnecting the generally conical speaker diaphragm and supporting basket. In conventional fashion, the acoustical transducer includes a generally conical speaker diaphragm supported within a vented basket having an open front and a rear wall. The large, front end of the diaphragm is flexibly connected to the front of the basket by means of a supple annulus. The basket has a rear wall having an upstanding boss which is coaxial with the diaphragm and smaller in diameter than the small end of the diaphragm. A flexible spider interconnects the small end of the diaphragm with the boss, allowing full excursion of the vibrating speaker diaphragm. To allow for maximum excursion of the diaphragm, the rear wall of the basket may be concave as viewed from the rear.

6 Claims, 4 Drawing Figures

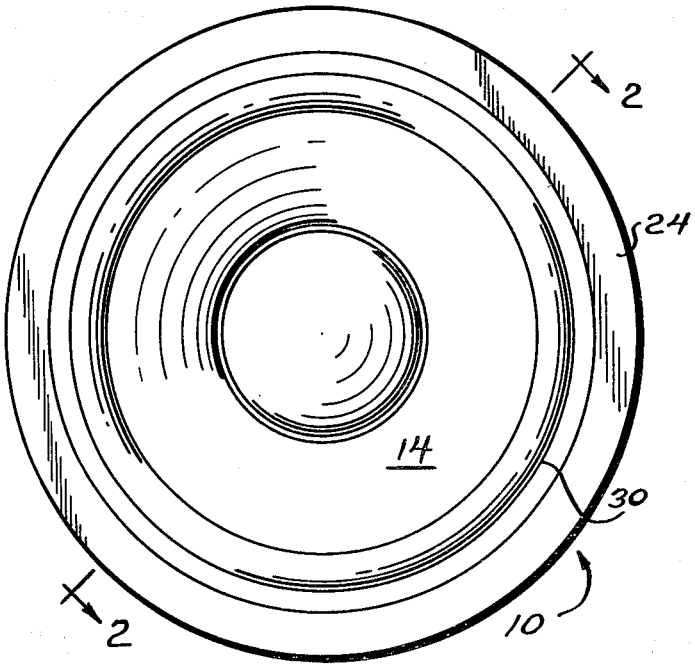
Fig. 1
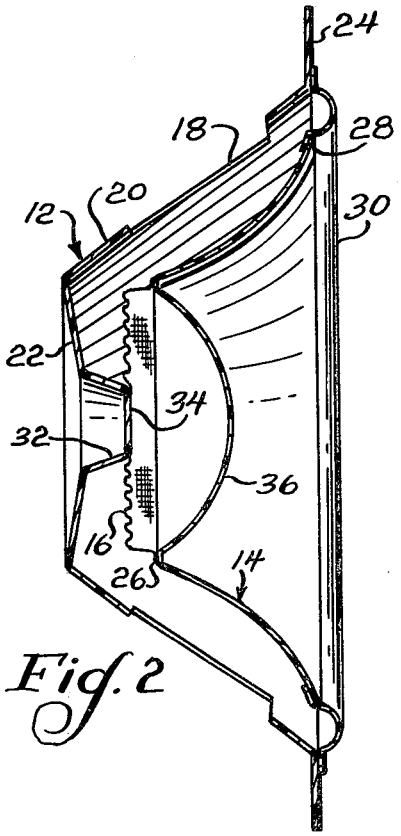
Fig. 2
Fig. 3
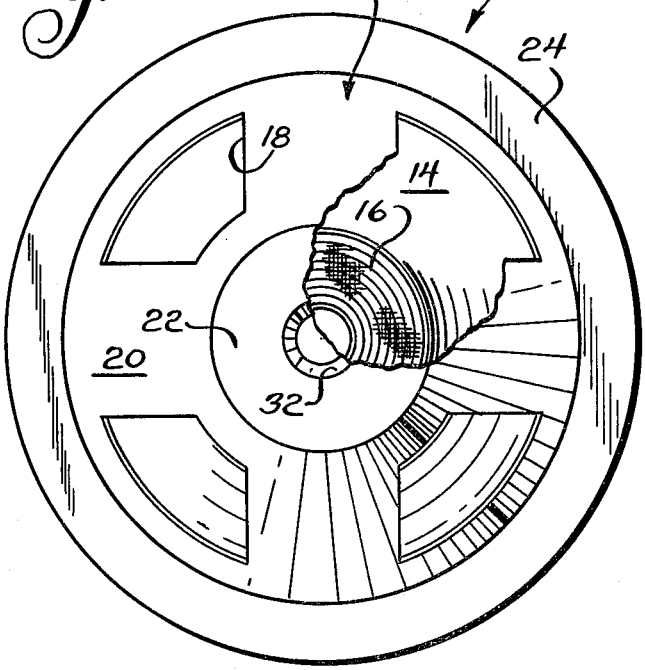
Fig. 4
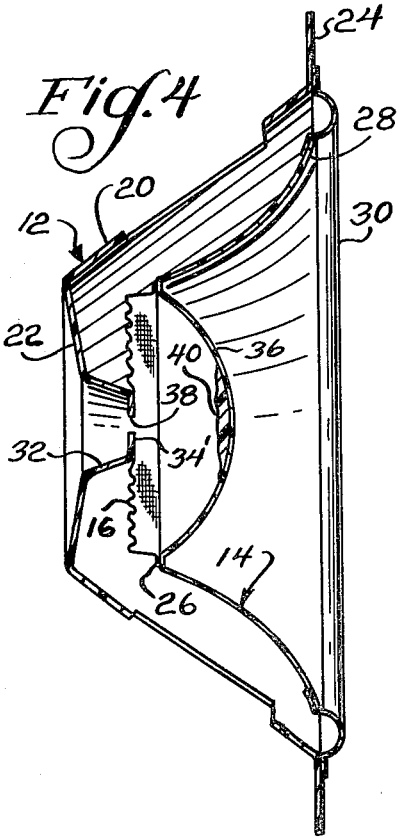

DRONE ACOUSTICAL TRANSDUCER

SUMMARY OF THE INVENTION

The Background

This invention relates to acoustical transducers, especially to a loudspeaker system which includes a drone acoustical transducer that is driven by the acoustic pulsations of at least one active electroacoustic transducer and more particularly to the drone transducer, itself.

Drone acoustical transducers are well known and are usually employed in connection with a bass-reflex type of loudspeaker system. In the typical drone acoustical transducer of the prior art, the conical transducer diaphragm is disposed within a vented basket, the large end of the diaphragm being connected to the basket by a compliant annulus as in conventional practice in loudspeakers. The diaphragm converges to its inner, small end, terminating and being attached to the center part of a flexible spider. The spider in turn extends radially outwardly and its periphery is affixed to the internal wall of the basket at the base thereof.

A distinct drawback of prior art drone transducers is the necessary depth of the transducer diaphragm and of the supporting basket. Since the spider is used to support the small end of the diaphragm, it must have a sufficient radial dimension to allow full vibrational movement of the diaphragm. Thus, the prior art speaker diaphragms must be relatively deep so that the radial dimension of the spider between the small end of the diaphragm and the basket may be sufficiently large to prevent interference with its action.

The Invention

The above and other disadvantages of drone transducers of the prior art are overcome by the present invention which provides a drone acoustical transducer for a loudspeaker system which faithfully reproduces the acoustic pulsations of an active loudspeaker, yet occupies considerably less depth than the conventional system.

In accordance with the invention, there is provided a drone acoustical transducer having an external, vented basket with an open front and a rear wall. Disposed within and supported by the basket is a generally conical transducer diaphragm which is truncated at its rear, small end and open at its front, large end. The front end of the speaker diaphragm is flexibly connected to the open front of the basket.

An upstanding boss is located in the rear wall of the basket, extending inwardly toward the speaker diaphragm, coaxially therewith. The diameter of the top of the boss is substantially less than the diameter of the small end of the diaphragm. An air pervious spider flexibly supports the small end of the diaphragm from its point of attachment to the top of the boss.

Preferably, the rear wall of the basket is concave inwardly toward the diaphragm in order to allow a greater excursion of the diaphragm than were the rear wall flat. The degree of concavity of this portion of the basket depends upon the extent of excursion of the speaker diaphragm to be accommodated by the combination of the boss and the concave wall.

A dome extends into the interior of the speaker diaphragm beyond the boss and is connected to or integral with the truncated small end of the diaphragm. Preferably, the dome is an integral part of the diaphragm and has a depth sufficiently great to avoid interference with movement of the speaker diaphragm.

As an option and in order to increase the mass of the combined dome and diaphragm structure as may be required for optimum performance, an aperture may be provided in the top of the boss to allow introduction therethrough of additional material ballasting to the underside of the dome. This material may be a plastic or other suitable adhesive material in a liquid form which, after insertion through the aperture to the underside of the dome will dry or set up and permanently adhere to the inner surface of the dome.

The spider extends radially outwardly from the top of the boss to the small end of the diaphragm. The spider is increased in area and radius by shortening, rather than deepening, the depth of the acoustical transducer.

BRIEF DESCRIPTION OF THE DRAWING

The invention is illustrated in greater detail in the drawing, in which:

FIG. 1 is a front view of a drone acoustical transducer according to the invention;

FIG. 2 is a cross-sectional illustration of the transducer taken along line 2—2 of FIG. 1;

FIG. 3 is a rear view of the transducer of FIG. 1 with portions removed to show portions of the interior, and FIG. 4 is a cross-sectional illustration of a modification of the invention including a weighting material adhering to the dome.

DETAILED DESCRIPTION OF THE INVENTION

Turning now to the drawing, a drone acoustical transducer according to the invention is generally depicted at 10. The transducer includes as primary components a basket 12, a diaphragm 14, and a spider 16.

The basket 12 includes a plurality of vents or windows 18 located in the conical side 20. As is well known in the art, the number and size of the vents 18 are sufficient to permit pulsating air flow as driven by the active loudspeaker of the system (not shown) to, in turn, drive the drone acoustical transducer.

The basket 12 includes a generally flat rear wall 22 connected or integral with the side 20. It also includes an annular flange 24 at the rim of the side 20, the open front of the basket. Preferably the flange 24, side 20 and bottom 22 are integrally molded from a suitably stiff plastic material, although the basket may be fabricated from metal.

The transducer diaphragm 14, which is substantially air impervious, is generally conically shaped as illustrated, and is truncated at its convergent end 26. The front, divergent end 28 of the diaphragm 14 is flexibly attached to the flange 24 by means of a supple annulus or surround 30. In a conventional manner, the annulus 30 allows axial excursion of the diaphragm 14 with minimal interference, while imperviously sealing the diaphragm to the basket to prevent dirt and air passage. The annulus 30 is cemented to the flange 24 and diaphragm 14.

The rear 22 of the basket 12 includes an upstanding frustoconical boss 32 extending toward the speaker diaphragm 14. The center portion of the spider 16 is cemented to the top 34 of the boss 32 as illustrated. The outer circumference of the spider 16 is cemented to the convergent end 26 of the frustoconical transducer diaphragm 14. The diameter of the top 34 of the boss is considerably less than the diameter of the convergent end 26 of the diaphragm 14, therefore allowing a relatively large spider 16 to be employed in connecting the diaphragm to the fixed boss. Since the spider 16 is totally contained between the diaphragm 14 and the boss 32, the outer circumference of the spider 16 extends no farther than the convergent end 26.

The spider 16 is preferably an air permeable material, such as a resin impregnated cloth, shaped in an annularly corrugated fashion to maintain the diaphragm laterally stable, yet allow free axial translation of the diaphragm responsive to impinging sound waves. The spider is cemented to the top 34 of the boss 32 and the convergent end 26 of the diaphragm 14 as shown.

Dome 36 closes the diaphragm 14 at the convergent end 26 and forms a part of the acoustic energy radiating diaphragm system. The dome 36 is of a sufficient height within the diaphragm 14 so that it does not strike the boss 32 during maximum excursion of the diaphragm 14 within the basket 12. The dome may be an integral portion of the diaphragm, as illustrated, or may be separate and cemented to the diaphragm.

As shown in FIGS. 2 and 4, the rear wall 22 of the basket 12 may be concave inwardly toward the speaker diaphragm. This structure allows even greater excursion of the diaphragm within the basket 12 for a given height of the boss 32. Also, although not so shown, wall 22 may be perforated or otherwise rendered air pervious if desired.

Shown in FIG. 4 is a modification of the invention in which the top 34' of the boss 32 includes an aperture 38. Employment of the aperture 38 allows access to the space within dome 36 and thus the introduction of additional mass into the diaphragm/dome vibrating system. A weighting material 40 may be inserted through the aperture 38 to the inside of the dome 36 where it will dry or set and adhere. This may be done by injecting a suitable material in liquid form through a nozzle which is inserted into aperture 38 while the diaphragm rests face down so that the material will settle in the position shown, by gravity. So increasing the mass of the dynamic portion of the transducer will affect its resonant frequency. Additional mass can alternatively be added to the system by cementing a solid ring or applying a settable adhesive liquid in a ring to the diaphragm system at the juncture of the diaphragm 14 and the dome 36.

The materials and shapes of the various components of the invention can be many and altered depending on the design needs of the particular application. For example, the basket 12 can be formed of any material, such as metal or may be thermoformed from suitable plastic sheet, that maintains its shape and will dependably support the diaphragm in the transducer and supports the drone transducer in an opening in the loudspeaker system. The spider 16 may be formed of any permeable material, such as resin-impregnated cloth, foam or metal springs which will prevent sagging or wobbling of the diaphragm 14 and yet allow freedom of movement of the diaphragm. The diaphragm 14 can be formed of paper, plastic, metal or, generally, any material that would be suitable for the diaphragms of active loudspeakers.

The novel structure of the invention allows use of a shallower overall transducer structure because the depth of the diaphragm 14 may be considerably less than the conventional diaphragm which extends toward and approaches an apex and which is supported by a spider radially external to the diaphragm. In the present invention, as the depth of the frustoconical diaphragm and of the overall structure is shortened, the distance between the convergent end 26 and the boss 32 increases, so that a larger spider must be used, resulting in greater compliance. Precisely the opposite results in the prior art structures where, as the depth of the transducer is shortened, the spider, which extends radially outwardly from the convergent end of the speaker diaphragm to the basket, will be radially smaller, resulting in less compliance of the spider with the movement of the speaker diaphragm. Therefore, the prior art has found that in order to increase the compliance of the spider, the overall depth of the transducer must be increased.

Various changes may be made to the structure of the invention without departing from the spirit thereof or scope of the following claims.

What is claimed is:

1. A drone acoustical transducer for a loudspeaker system, comprising
   a. an external, vented basket having an open front and a rear wall,
   b. a generally conical transducer diaphragm located within said basket, said diaphragm being truncated at its convergent end and being open at its divergent end,
   c. means flexibly connecting the divergent end of said diaphragm to the front of said basket,
   d. a boss extending inwardly from the rear of said basket, the diameter of the top of said boss being smaller than the diameter of the convergent end of said diaphragm,
   e. spider means flexibly interconnecting the convergent end of said diaphragm with the top of said boss, and
   f. said rear wall of the basket being concave inwardly toward the diaphragm to allow excursion of the diaphragm to depths within the basket greater than the height of said boss.

2. The acoustical transducer of claim 1 including a dome extending into the interior of the diaphragm, said dome being affixed at its periphery to the convergent end of the diaphragm.

3. The acoustical transducer of claim 2 in which said dome is an integeral part of said diaphragm and has a depth at least as great as the height of said boss.

4. The acoustical transducer of claim 2 including weighting material applied to the underside of said dome to increase the mass of the dome-diaphragm system.

5. The acoustical transducer of claim 4 including an aperture in the top of said boss, said aperture being of sufficient size to allow introduction of said weighting material.

6. The acoustical transducer of claim 1 in which said spider means comprises a spider affixed at its center to said boss and extending radially outwardly from the top of said boss to the convergent end of said diaphragm.

* * * * *